United States Patent [19]

Kudlicka

[11] Patent Number: 4,462,627

[45] Date of Patent: Jul. 31, 1984

[54] LIFT FRAME ASSEMBLY

[75] Inventor: Mark L. Kudlicka, Lake Oswego, Oreg.

[73] Assignee: Cranston Machinery Co., Inc., Oak Grove, Oreg.

[21] Appl. No.: 357,984

[22] Filed: Mar. 15, 1982

[51] Int. Cl.[3] ..... B66C 1/66

[52] U.S. Cl. ..... 294/81 SF; 294/67 AA

[58] Field of Search ..... 294/81 R, 81 SF, 86 LS, 294/67 AA, 67 DA, 67 R, 67 A, 67 AB, 67 B, 67 BB, 103 R, 63 R; 414/137, 138, 139

[56] References Cited

U.S. PATENT DOCUMENTS 3,148,909 9/1964 Tantlinger ..... 294/81 SF 3,244,446 4/1966 Bopp ..... 294/67 AA

*Primary Examiner*—James B. Marbert

*Attorney, Agent, or Firm*—Lee R. Schermerhorn

[57] ABSTRACT

An elongated lift frame, lifted and moved by a crane, has a plurality of transverse spreader bars which may be shifted to different positions along the frame. The spreader bars have extensions in their ends equipped with supports for load hooks. A latch pin at each end of each spreader bar secures its extension in extended or retracted position and secures the spreader bar in a selected position on the lift frame.

11 Claims, 10 Drawing Figures

LIFT FRAME ASSEMBLY

BACKGROUND OF THE INVENTION

This invention relates to a lift frame assembly adapted to be lifted and moved by a crane or other lifting device and having load hooks for lifting a plurality of bundles or other objects.

A lift frame is of advantage, for example, in lifting bundles of bales of paper pulp wherein a number of bales are bound together in a single bundle by suitable strapping material. Each load hook on the lift frame is then releasably attached to the strapping on a bundle making the lift frame capable of handling a plurality of such bundles in each operation of the crane.

The bundles may vary in size depending on the size of the bales and the number of bales included in each bundle. This makes it desirable to vary the spacing of the load hooks both longitudinally and transversely of the lift frame in order to group the bundles in compact relationship and carry as many bundles as possible with a lift frame of given size. Open spaces between the bundles reduce the capacity of the lift frame and require more crane operations, and hence more time, to move a given amount of material.

SUMMARY OF THE INVENTION

The present lift frame comprises a pair of parallel horizontal beams supporting a plurality of transverse spreader bars having spreader bar extensions in their outer ends. The outer end of each extension is equipped with supporting means for individual load hooks, each load hook being detachably connected with one of the bundles. The spreader bar extensions may be extended outward from or retracted into the spreader bars to vary the transverse spacing of the load supporting means and the spreader bars may be shifted longitudinally on the beams of the lift frame to vary the number and spacing of the spreader bars longitudinally of the lift frame.

An important feature of the present construction is a novel latch pin assembly for performing the dual function of holding a spreader bar extension in either extended or retracted position and for holding the speader bar in a selected position longitudinally of the lift frame beams. Lifting the latch pin a short distance releases the spreader bar extension for movement between extended and retracted positions and when the latch pin is released a spring on the latch pin causes the latch pin to lock the spreader bar extension in the desired extended or retracted position.

Lifting the latch pin to the limit of its movement allows the spreader bar to be shifted longitudinally along the lift frame beams and then release of the latch pin causes it to lock the spreader bar in the selected position. The latch pins are not removable whereby they cannot become lost or misplaced.

The invention will be better understood and additional objects and advantages will become apparent from the following description of the preferred embodiment illustrated in the accompanying drawings. Various changes may be made in the details of construction and arrangement of parts and certain features may be used without others. All such modifications within the scope of the appended claims are included in the invention.

DESCRIPTION OF THE PREFERRED EMBODIMENT

Figure 1:
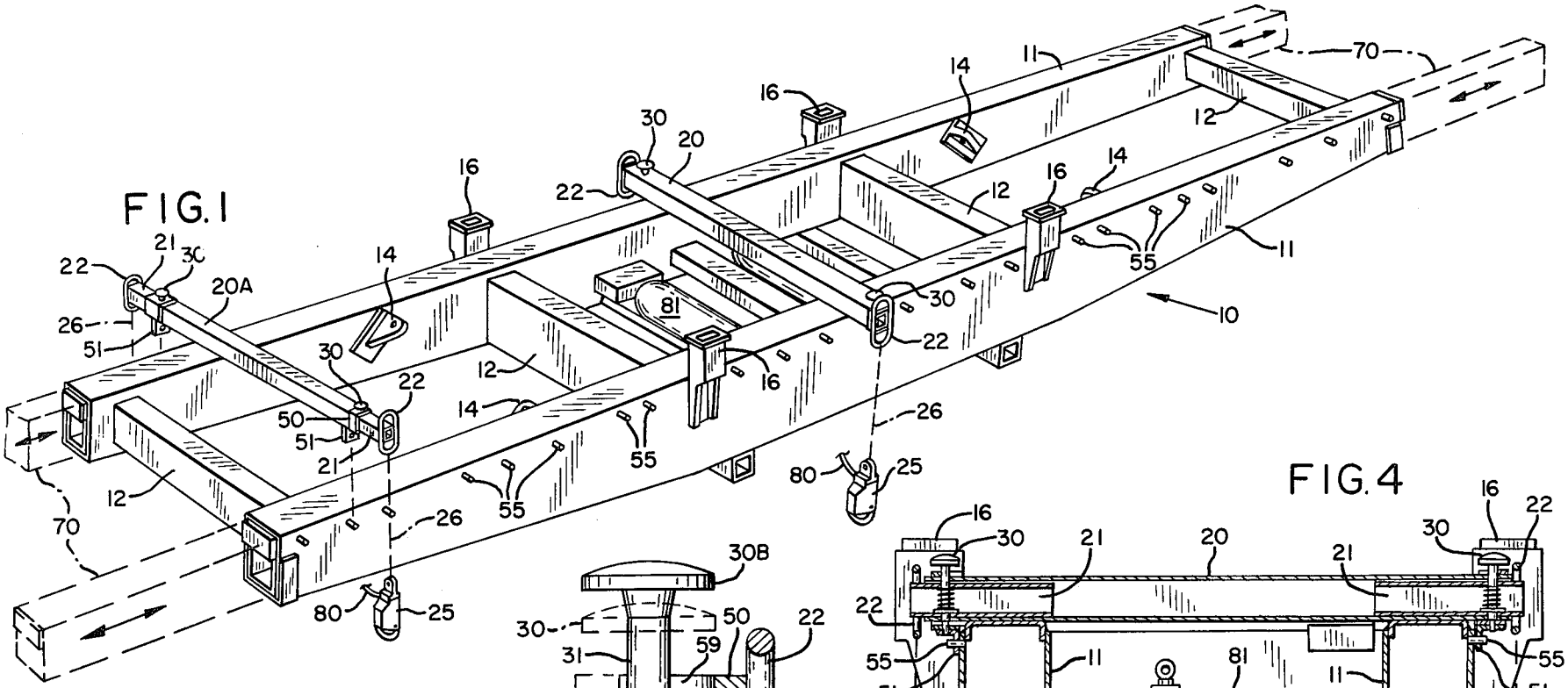
FIG. 1 is a perspective view of a lift frame assembly embodying the invention.
Figure 2:
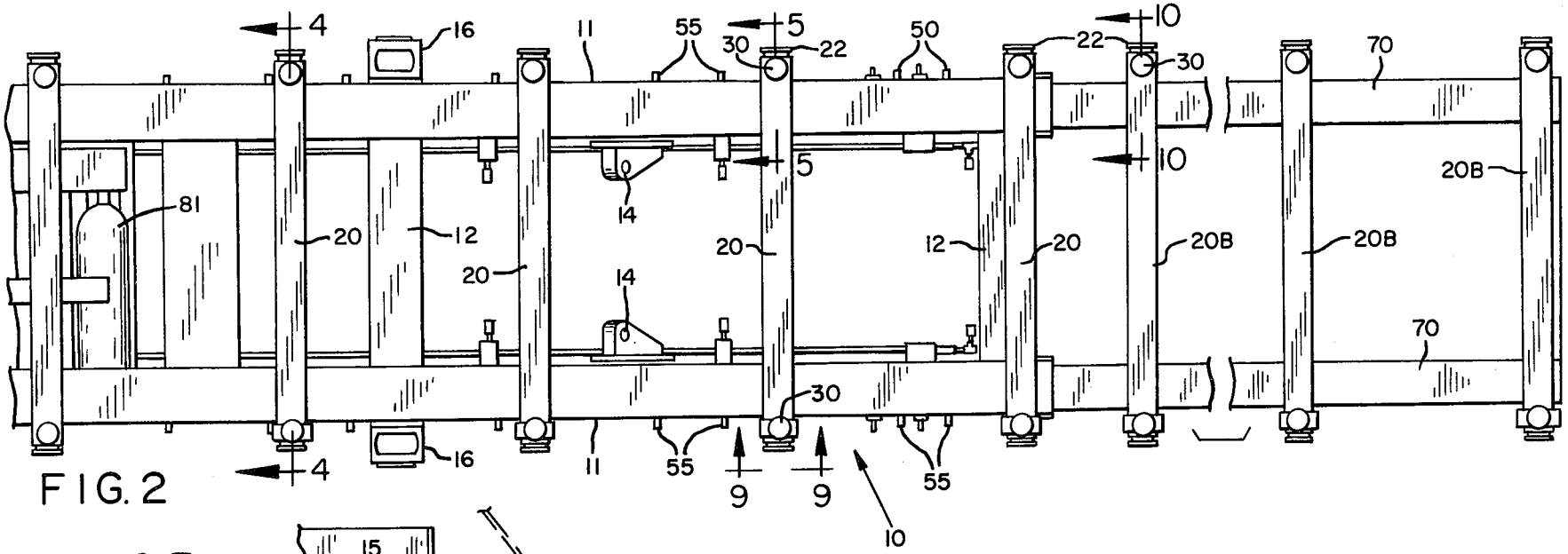
FIG. 2 is a top plan view with parts broken away.
Figure 3:
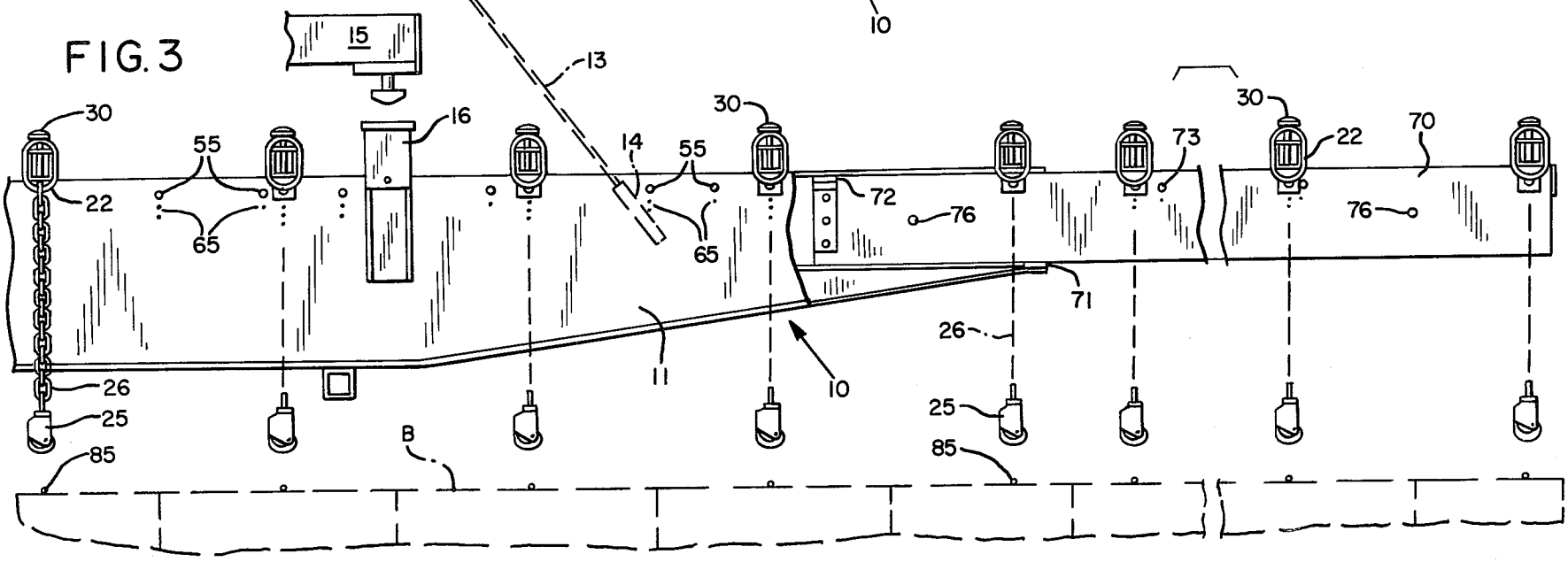
FIG. 3 is a side elevation view of FIG. 2 with parts in section.

As seen in FIGS. 1, 2 and 3 the lift frame assembly comprises a pair of longitudinally horizontal beams 11 interconnected by plurality of cross members 12 which are welded to the beams. The lift frame may be lifted and moved by a lift cable from a crane or other lifting device having four sling cables 13 connected to four brackets 14 on the beams 11 as shown in FIG. 3. The lift frame may also be lifted by a container latch device 15 which engages four sockets 16 on the lift frame.

The beams 11 support a plurality of transverse spreader bars 20, only one of which is shown in position on the beams in FIG. 1. Another spreader bar 20A is shown removed from the beams. The spreader bars 20 may be shifted to diffferent positions long the beams 11 and spreader bars may be added or removed as the work requires.

Figure 5:
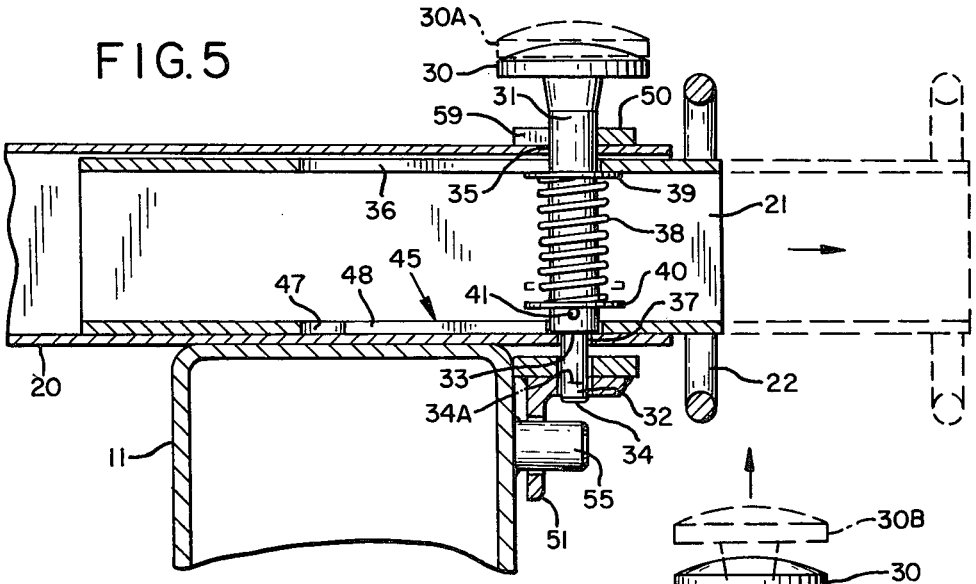
FIG. 5 is a sectional view on the line 5—5 in FIG. 2.

Turning now to FIG. 5 it will be seen that the spreader bars 20 are tubular and the opposite ends of each spreader bar each contain a tubular extension 21 which is shown in retracted position in solid lines and in extended position in broken lines, the extension being slidable within the spreader bar. Welded to the outer end of each extension 21 is a load supporting ring 22 from which a pneumatically releasable load hook 25 is suspended by a chain 26 as seen in FIGS. 1 and 3.

A vertical latch pin 30 has a large diameter shank portion 31 with a small diameter lower end portion 32. The large diameter portion 31 terminates at shoulder 33 and the small diameter portion 32 terminates at the end of the pin at 34. The upper end of the large diameter portion 31 extends through a round hole 35 in the top wall of spreader bar 20 and a longitudinal slot 36 in the top wall of extension 21. The small diameter portion 32 extends through a circular hole 37 in the bottom wall of spreader bar 20 with the shoulder 33 being forced down against this bottom wall by a compression coil spring 38 confined between an upper washer 39 and a lower washer 40 which is held in place by a retaining pin 41.

Figure 8:
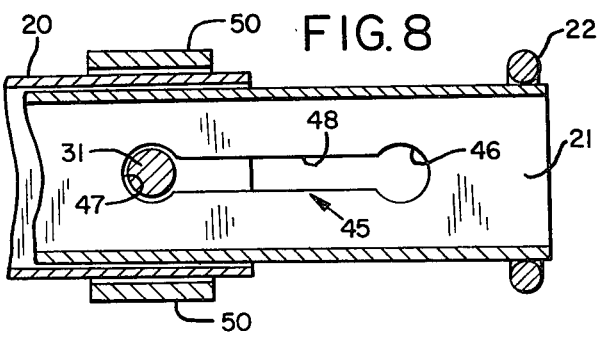
FIG. 8 is a sectional view on the line 8—8 in FIG. 6.
Figure 9:
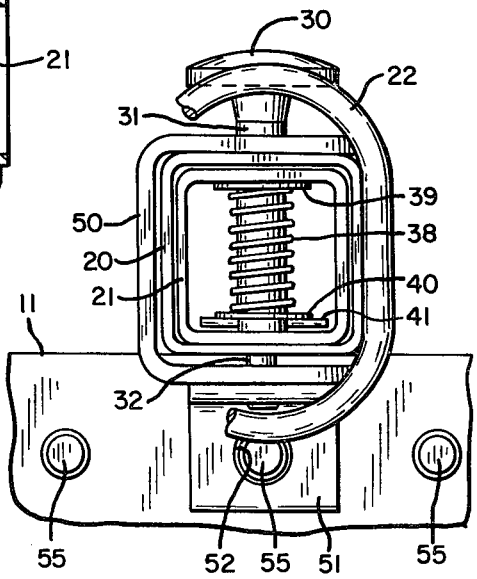
FIG. 9 is a view on the line 9—9 in FIG. 2 with parts broken away.

As shown in FIGS. 5 and 8 the lower wall of extension 21 has a longitudinal double keyhole slot 45 with enlarged ends 46 and 47 and a narrow intermediate portion 48. The enlarged end portions 46 and 47 will receive the large diameter portion 31 of the latch pin while the narrow portion 48 of the lot will not. Narrow slot portion 48 will receive only the small diameter lower end portion 32 of the latch pin.

Thus the extension 21 is held in retracted position as shown in solid lines in FIG. 5 by the large diameter portion 31 of the latch pin being locked in the end portion 46 of keyhole slot 45. To pull out extension 21 to its broken line position it is necessary to raise latch pin 30 to its broken line position 30A. This lifts shoulder 33 above the keyhole slot 45 and permits the narrow portion 48 of the keyhole slot to slide on the small diameter end portion 32 of the latch pin. When extension 21 is fully extended, the latch pin is released and spring 38 depresses the large diameter portion 31 of the latch pin into end portion 47 of the keyhole slot to lock the extension in extended position. Slot 45 may be provided with one or more additional enlargements like 46 and 47 in intermediate positions in the slot if it is desired to lock extension 21 in intermediate positions.

Figure 6:
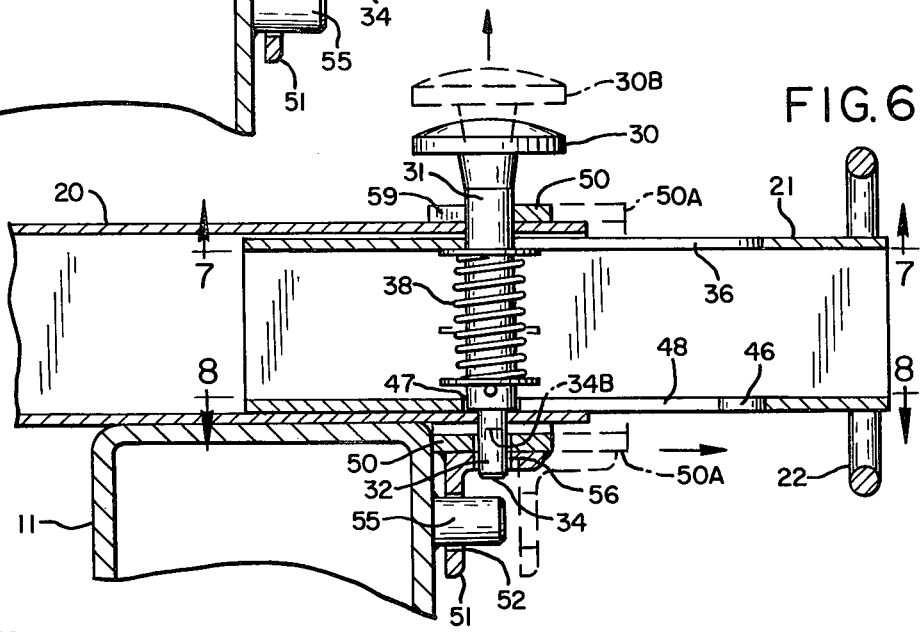
FIG. 6 is a view similar to FIG. 5 illustrating the dual function of the latch pin.
Figure 7:
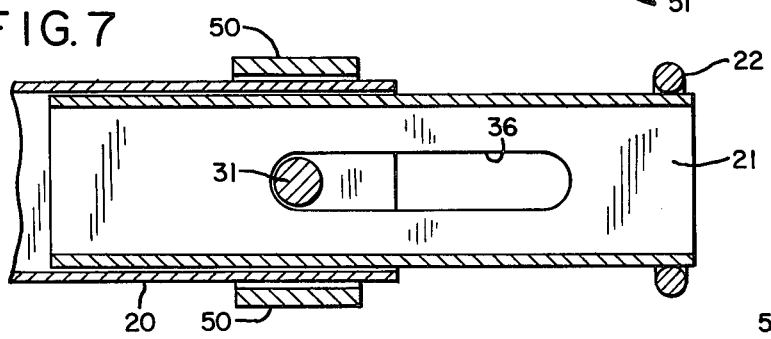
FIG. 7 is a sectional view on the line 7—7 in FIG. 6.

A second function of latch pin 30 is illustrated in FIG. 6. A rectangular collar 50 is slidable on spreader bar 20. Welded to the under side of this collar is a vertical plate 51 having an aperture 52 to receive any one of a plurality of outstanding locating pins 55 located at intervals along the beam 11. Also on the underside of collar 50 is an aperture 56 to receive the lower end portion 32 of the latch pin 30 whereby the spreader bar is secured to the beam 11. When latch pin 30 is raised a short distance to position 30A in FIG. 5 to release extension 21, as described above, the lower end of the latch pin at 34A is still engaged in aperture 56 so that spreader bar 20 cannot be moved along beam 11 or removed from the beam.

When latch pin 30 is raised farther, to position 30B in FIG. 6, the lower end of the latch pin is raised to position 34B and disengaged from aperture 56 in collar 50 allowing the collar to be pulled out to its broken line position at 50A causing the collar plate 51 to disengage locating pin 55. When the latch pins on both ends of the spreader bar are thus raised to upper position, the spreader bar may be shifted along the beam 11 to different locating pins 55 or the spreader bar may be removed from the beams 11 if desired. The upper side of collar 50 has a slot at 59 to allow the upper side of the collar to disengage the latch pin in position 50A.

As seen in FIG. 3 the locating pins 55 are identified by a code of dots 65 on the outer sides of beams 11. Thus in the present illustration of a lift frame for paper pulp bales one dot indicates the proper positions of the spreader bars 20 for nine 30½" wide bundles, two dots indicates the proper positions of the spreader bars for eight 33" wide bundles and three dots indicates the proper positions for nine 33" wide bundles. The bundles of bales extend across the width of the lift frame and the opposite side of the lift frame appears the same as FIG. 3. For carrying other objects the locating pins 55 are appropriately spaced according to the size of the objects to accomplish a compact loading arrangement.

The beams 11 are tubular and are equipped with telescoping extensions 70 to receive additional spreader bars 20B as shown in FIGS. 2 and 3. The outer end of each beam bottom wall is provided with a wear plate 71 and the inner end of each extension top wall is provided with a wear plate 72 to faciliatate the sliding movements.

Figure 10:
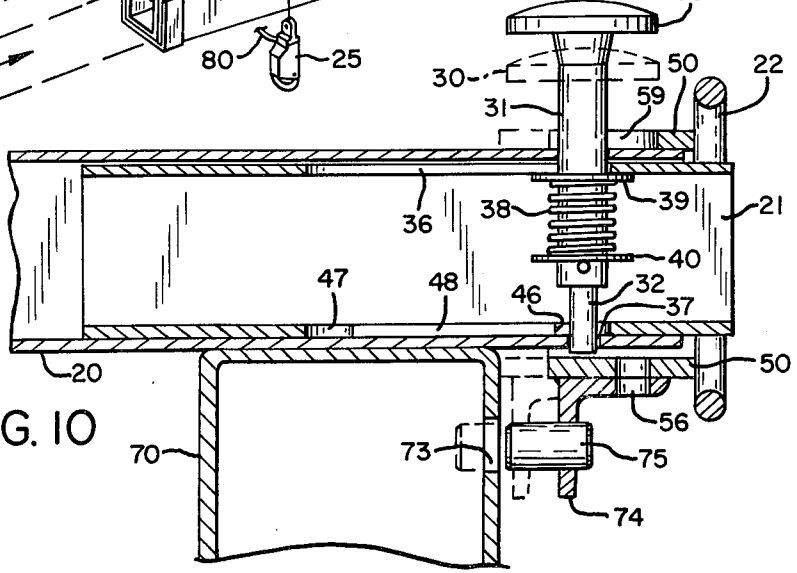
FIG. 10 is a view on the line 10—10 in FIG. 2.

The beam extensions 70 have locating holes 73 and the collar plates 74 have pins 75 as shown in FIG. 10, thus reversing the positions of these parts 52 and 55 in FIG. 6 so that extensions 70 will slide within beams 11. The operation of the latch pin assembly in FIG. 10 is otherwise the same as described in connection with FIGS. 5 and 6. The beam extensions 70 are locked in extended positions by bolts in registering holes 76 in FIG. 3, in beams 11 and extensions 70.

Thus the extensions 70 increase the capacity of the lift frame from nine to fifteen bundles in the one dot positions of the spreader bars and from eight to fourteen bundles in the two dot positions.

Figure 4:
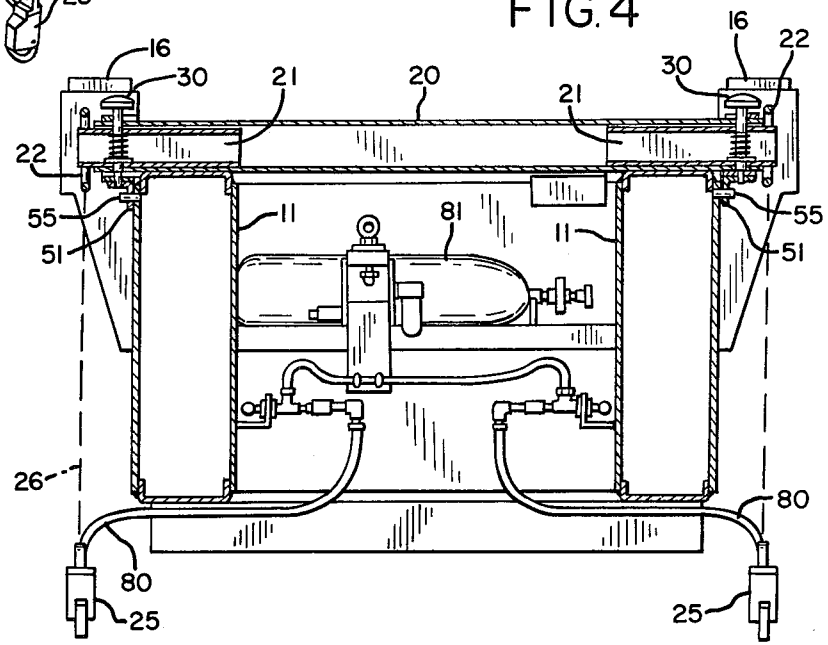
FIG. 4 is a sectional view on the line 4—4 in FIG. 2.

As previously mentioned, the load hooks 25 are pneumatically releasable. Each hook is released by compressed air supplied through a flexible hose 80 from air tanks 81 in the lift frame as seen in FIG. 4. A suitable release mechanism is provided, for example as shown in application Ser. No. 299,810 filed Sept. 8, 1981 and assigned to the assignee of the present application.

As seen in FIG. 3 the load hooks 25 are adapted to hook the strappings 85 on a series of bundles B to lift the bundles or other objects. After the bundles have been lifted and moved by the crane they are set down in a different location and the hooks are released simultaneously by the release mechanism referred to.

What is claimed is:

1. A lift frame comprising a pair of parallel horizontal longitudinal beams interconnected by cross members, a plurality of transverse spreader bars mounted for movement to different positions along said beams, spreader bar extensions slidable outward from the ends of said spreader bars, load supporting means on the outer ends of said extensions, and a dual function latch pin in each end of each of said spreader bars, each latch pin securing the adjacent spreader bar extension in extended and retracted positions and securing the adjacent end of its spreader bar in different selected positions along the adjacent beams, said latch pin having a short range of sliding movement to release its spreader bar extension for extension or retraction and having a longer range of sliding movement to release said adjacent end of the spreader bar for said movement along said adjacent beam.

2. A lift frame as defined in claim 1, said spreader bars being tubular and said spreader bar extensions being tubular and slidable within said spreader bars.

3. A lift frame as defined in claim 2 including a double keyhole slot in each of said extensions having enlarged end portions to be locked by a portion of said latch pin when the extension is retracted or extended.

4. A lift frame as defined in claim 3 including a compression coil spring on said latch pin to return the latch pin to latched position after each manipulation and a spring retainer pin in said latch pin, said spring and retainer pin preventing removal of said latch pin.

5. A lift frame as defined in claim 3 including a collar slidable on said spreader bar to engage and disengage locating pins at spaced points along one of said beams, the end of said latch pin normally engaging said collar to hold the collar engaged with one of said locating pins, said latch pin when moved in said longer range of movement disengaging said collar and allowing the collar to be disengaged from said locating pin to allow movement of the spreader bar along the beam.

6. A lift frame as defined in claim 5, said locating pins projecting horizontally from a side of said beam and said collar having an apertured vertical plate to engage said locating pins.

7. A lift frame as defined in claim 5 wherein said engagement of said collar with one of said locating pins secures the spreader bar to said beam and disengagement of said collars at opposite ends of said spreader bar releases the spreader bar for removal from said beams.

8. A lift frame as defined in claim 1 including beam extensions slidable outward from the ends of said beams, and spreader bars on said beam extensions.

9. A lift frame as defined in claim 8, said beam being tubular and said beam extensions being slidable within said beams.

10. A lift frame as defined in claim 9 including spreader bar extensions in the ends of said beam extension spreader bars and a sliding latch pin in each end of each of said last spreader bars having a short range of movement to release its spreader bar extension for extension or retraction and having a longer range of movement to release the spreader bar for movement along said beam extensions.

11. A lift frame as defined in claim 1 including pneumatically releasable load hooks suspended from said load supporting means, and compressed air means in said lift frame for releasing said hooks from their loads.

* * * * *